US006367636B1

(12) United States Patent
Walker

(10) Patent No.: US 6,367,636 B1
(45) Date of Patent: Apr. 9, 2002

(54) KITCHEN DEVICE FOR RESTING ON COUNTER TOP AND PITCHING A DRAIN BOARD SUPPORTED THEREON INTO A SINK IN THE COUNTER TOP

(76) Inventor: Noel G. Walker, 37 Harding Ave., Morton, PA (US) 19070

( * ) Notice: Subject to any disclaimer, the term of this patent is extended or adjusted under 35 U.S.C. 154(b) by 0 days.

(21) Appl. No.: 09/633,805

(22) Filed: Aug. 7, 2000

(51) Int. Cl.[7] ..... A47G 19/08
(52) U.S. Cl. ..... 211/41.3
(58) Field of Search ..... 211/41.3, 41.5, 211/41.6, 41.2, 41.1; 248/346.01

(56) References Cited

U.S. PATENT DOCUMENTS

| | | | | | |
|---|---|---|---|---|---|
| 1,714,266 | A | * | 5/1929 | Johnson | 211/41.3 |
| 1,810,199 | A | * | 6/1931 | Blakeslee et al. | 211/41.3 |
| 1,835,232 | A | * | 12/1931 | Lord | 211/41.6 |
| D244,827 | S | | 6/1977 | Nevai | D7/188 |
| 4,169,638 | A | * | 10/1979 | Cirasuolo et al. | 211/41.6 |
| 4,372,448 | A | | 2/1983 | Drach | 211/41 |
| 4,480,343 | A | | 11/1984 | Drach | 4/656 |
| 5,119,943 | A | * | 6/1992 | Hoang | 211/41.3 |
| D337,186 | S | | 7/1993 | Drach | D32/56 |
| 5,480,035 | A | | 1/1996 | Smith | 211/41 |
| 5,660,284 | A | * | 8/1997 | Vaughn | 211/41.1 |
| 5,704,492 | A | * | 1/1998 | Bartko | |

* cited by examiner

*Primary Examiner*—Alvin Chin-Shue
*Assistant Examiner*—Sarah Purol
(74) *Attorney, Agent, or Firm*—Richard L. Miller, P.C.

(57) ABSTRACT

A kitchen device for resting on a counter top and pitching a drain board supported thereon into a sink in the counter top that includes a bottom wall, a pair of side walls, and, a rear wall. The bottom wall includes a plurality of slats for supporting the drain board on a depending incline towards the sink, and which are spaced-apart from each other for providing drainage for leaks from the drain board. Each terminal end of each slot is formed into a tenon. Each side wall is generally right-triangular-shaped, and as a result thereof, has a leg for resting horizontally on the counter top, a base that extends vertically upwardly from the leg, a hypothenuse that depends inclined from the base forwardly to thevertex, an interior surface that faces the other side wall, and an exterior surface for facing the ambient. The interior surface of each side wall has a plurality of blind mortises that are disposed in line with each other, below, and parallel to, the hypotenuse. The vertex of each side wall is rounded and depends into a recess in the leg for engaging the rim of the sink so as to provide a stop for preventing the kitchen device from sliding into the sink. The tenon on one terminal end of each slot is received in an associated blind mortise in the interior surface of one side wall, while the tenon on the other terminal end of each slot is received in an associated blind mortise in the interior surface of the other side wall.

20 Claims, 2 Drawing Sheets

KITCHEN DEVICE FOR RESTING ON COUNTER TOP AND PITCHING A DRAIN BOARD SUPPORTED THEREON INTO A SINK IN THE COUNTER TOP

BACKGROUND OF THE INVENTION

1. Field of the Invention

The present invention relates to a kitchen device. More particularly, the present invention relates to a kitchen device for resting on a counter top and pitching a drain board supported thereon into a sink in the counter top.

2. Description of the Prior Art

Numerous innovations for kitchen draining devices have been provided in the prior art that will be described. Even though these innovations may be suitable for the specific individual purposes to which they address, however, they differ from the present invention.

A first example, U.S. Pat. No. Des. 244,827 to Nevai teaches the ornamental design for a cleaning and draining device.

A second example, U.S. Pat. No. Des. 337,186 to Drach teaches the ornamental design for a combination drain board and cutting board.

A third example, U.S. Pat. No. 4,372,448 to Drach teaches a device that has first and second opposing surfaces each including first and second planar sections. The sections of the first surface are inclined with respect to each other along a center line at an angle greater than 180 degrees and cooperate with upstanding side members to form drainage channels along the side of the first surface. The sections of the second surface are inclined with respect to each other at an angle less than 180 degrees to form a central drainage channel in the second surface. End members support each of the surfaces at an incline relative to the horizontal. One end member has drainage ports aligned with each of the channels and a container receiving opening, connected by means of a drainage channel, to the port aligned with the drainage channel on the second surface. The first surface has members thereon for retaining dishware, silverware and glassware. When used with the first surface facing upward, the device may be used as a dish rack and/or a drain board. When used with the second surface facing upward, the device may be used as a cutting board. In either orientation, the device may be used to wash food items.

A fourth example, U.S. Pat. No. 4,480,343 to Drach teaches a board that consists of a planar member having first and second surfaces. The first surface, upon which a dish rack may be placed is supported by legs at an incline and is provided with upwardly protrusions designed to engage the dish rack to prevent same from slipping along the first surface. The effective length of the support legs; can be altered to change the incline. Other protrusions extending from the first surface cooperate with upstanding walls to retain utensils. The second surface functions as a cutting board and is supported at an incline, in part, by the dish rack engaging protrusions. Upstanding parallel ribs form a horizontal platform above one of the surfaces.

A fifth example, U.S. Pat. No. 5,480,035 to Smith teaches an open dishrack for a dishwasher that has opposite sides formed of spaced apart elongated coated wires. A vertically adjustable shelf extends between the opposite sides. A pair of support plates include snap fittings which engage the wires to mount the plates on the sides in a facing relationship. Each plate includes an upper and a lower hub aligned with the corresponding hub of the other plate. The shelf includes projecting fingers which are received in a selected pair of hubs to rotatably mount the shelf in either an upper or a lower position. Each plate also includes a rib associated with each of its hubs to support the shelf in a generally horizontal orientation when the shelf is mounted in that hub. Each plate also includes a rib positioned to support the shelf in a generally vertical position when the shelf is mounted in the lower hubs. Each plate includes a cup or trunion positioned above its upper hub and a rod is received in the cups and extends across the dish rack to provide lateral support to items on the shelf and to support the shelf in a generally vertical orientation when the shelf is in its upper position.

It is apparent that numerous innovations for kitchen draining devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a kitchen device for resting on a counter top and pitching a drain board supported thereon into a sink in the counter top that avoids the disadvantages of the prior art.

Another object of the present invention is to provide a kitchen device for resting on a counter top and pitching a drain board supported thereon into a sink in the counter top that is simple and inexpensive to manufacture.

Still another object of the present invention is to provide a kitchen device for resting on a counter top and pitching a drain board supported thereon into a sink in the counter top that is simple to use.

Briefly stated, yet another object of the present invention is to provide a kitchen device for resting on a counter top and pitching a drain board supported thereon into a sink in the counter top that includes a bottom wall, a pair of side walls, and, a rear wall. The bottom wall includes a plurality of slats for supporting the drain board on a depending incline towards the sink, and which are spaced-apart from each other for providing drainage for leaks from the drain board. Each terminal end of each slot is formed into a tenon. Each side wall is generally right-triangular-shaped, and as a result thereof, has a leg for resting horizontally on the counter top, a base that extends vertically upwardly from the leg, a hypothenuse that depends inclined from the base forwardly to the vertex, an interior surface that faces the other side wall, and an exterior surface for facing the ambient. The interior surface of leach side wall has a plurality of blind mortises that are disposed in line with each other, below, and parallel to, the hypotenuse. The vertex of each side wall is rounded and depends into a recess in the leg for engaging the rim of the sink so as to provide a stop for preventing the kitchen device from sliding into the sink. The tenon on one terminal end of each slot is received in an associated blind mortise in the interior surface of one side wall, while the tenon on the other ;terminal end of each slot is received in an associated blind mortise in the interior surface of the other side wall.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows.

LIST OF REFERENCE NUMERALS UTILIZED IN THE DRAWING

Figure 1:
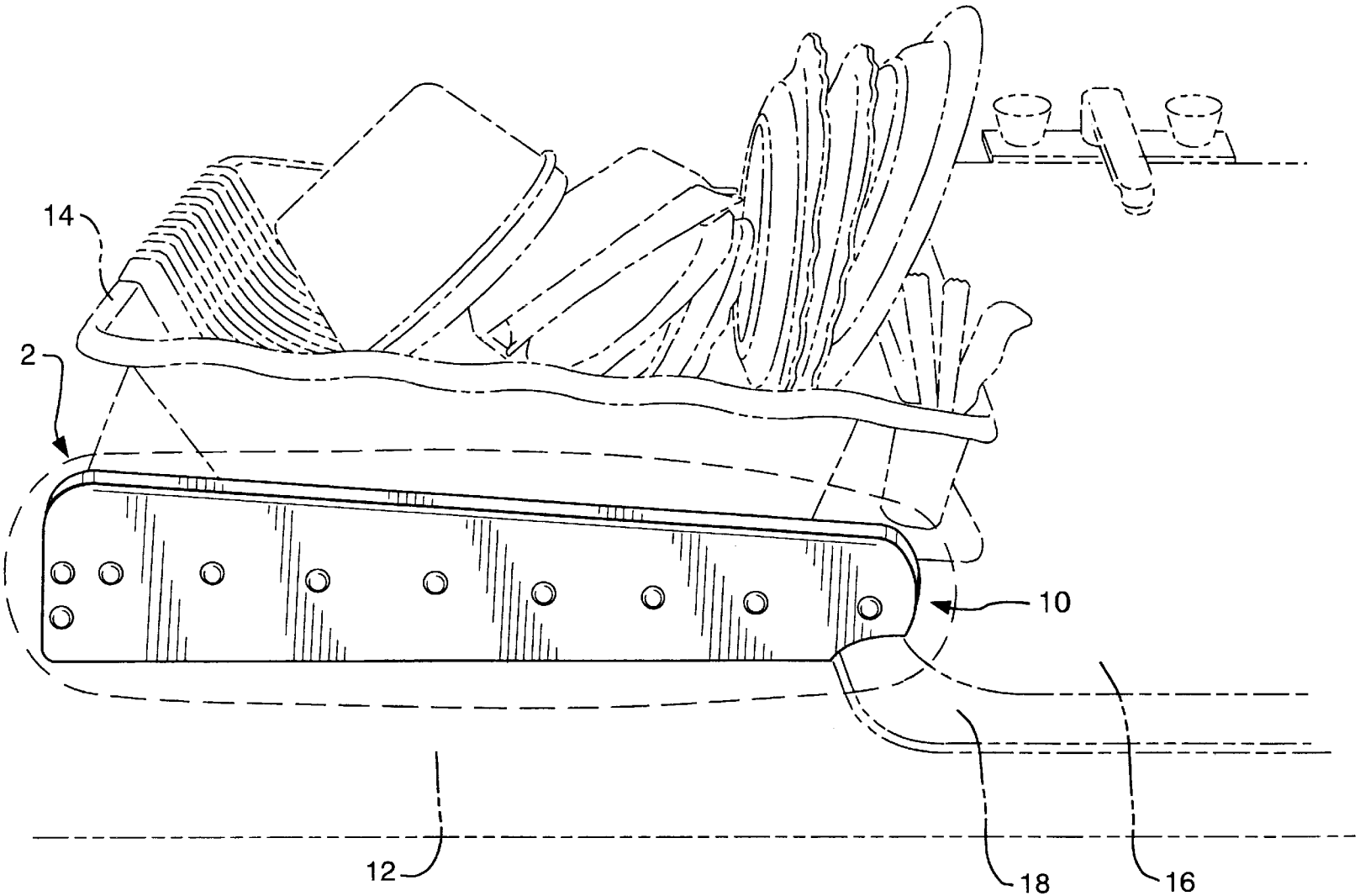
FIG. 1 is a diagrammatic perspective view of the present invention in use.

10 kitchen device of present invention for resting on counter top 12 and pitching drain board 14 supported thereon into sink 16 in counter top 12
12 counter top
14 drain board
16 sink in counter top 12
18 rim of sink 16 in counter top 12
20 bottom wall for facing counter top 12
22 pair of side walls for resting on counter top 12 and for cradling drain board 14 therebetween
24 rear wall for resting on counter top 12
26 plurality of slats of bottom wall 20 for supporting drain board 14 on incline towards sink 16 and for providing drainage for leaks from drain board 14
28 pair of terminal ends of each slat of plurality of slats 26 of bottom wall 20
30 tenon formed from each terminal end of pair of terminal ends 28 of each slat of plurality of slats 26 of bottom wall 20
32 leg of each side wall of pair of side walls 22 for resting horizontally on counter top 12
33 vertex of leg of each side wall of pair of side walls 22
34 base of each side wall of pair of side walls 22
36 hypothenuse of each side wall of pair of side walls 22
38 interior surface of each side wall of pair of side walls 22
40 exterior surface of each side wall of pair of side walls 22 for facing ambient
42 plurality of blind mortises in interior surface 38 of each side wall of pair of side walls 22
44 recess of vertex of each side wall of pair of side walls 22 in leg of each side wall of pair of side walls 22 for engaging rim 18 of sink 16 so as to provide stop for preventing kitchen device 10 from sliding into sink 16
46 plurality of countersunk bores on exterior surface 40 of each side wall of pair of side walls 22
48 plurality of wood screws of each side wall of pair of side walls 22
50 plurality of wood plugs of each side wall of pair of side walls 22
52 lowermost edge of rear wall 24 for resting on counter top 12
54 pair of ends of rear wall 24
56 pair of countersunk bores in exterior surface 40 of each side wall of pair of side walls 22
58 pair of wood screws of each side wall of pair of side walls 22
60 pair of wood plugs of each side wall of pair of side walls 22

DETAILED DESCRIPTION OF THE PREFERRED EMBODIMENT

Referring now to the figures, in which like numerals indicate like parts, and particularly to FIG. 1, the kitchen device of the present invention is shown generally at 10 for resting on a counter top 12 and pitching a drain board 14 supported thereon into a sink 16 in the counter top 12, wherein the sink 16 has a rim 18 therearound that rests on the counter top 12.

Figure 2:
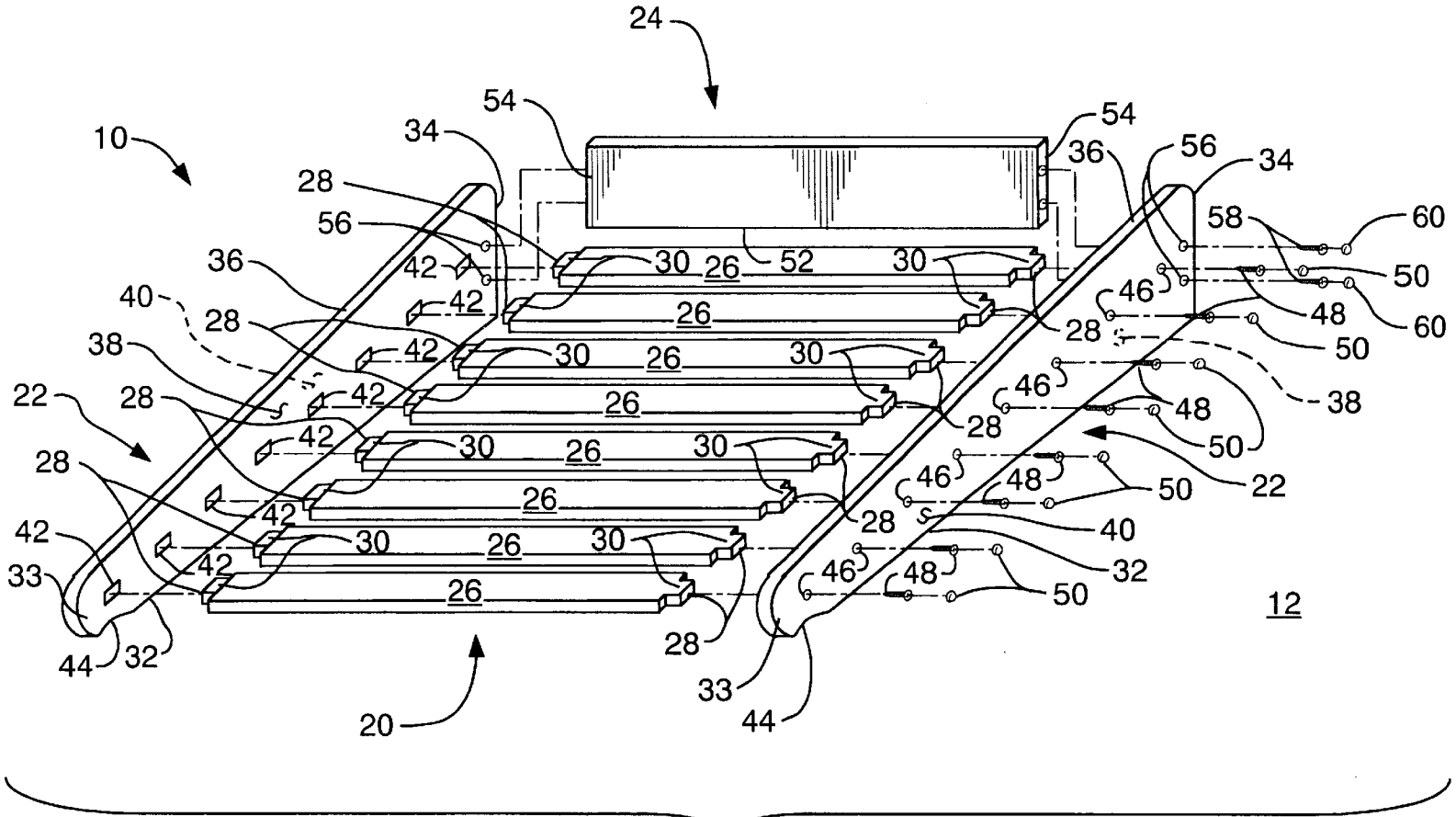
FIG. 2 is an exploded diagrammatic perspective view of the area generally enclosed by the dotted curve identified by arrow 2 in FIG. 1 of the present invention.

The configuration of the kitchen device 10 can best be seen in FIG. 2, and as such, will be discussed with reference thereto.

The kitchen device 10 comprises a bottom wall 20 for facing the counter top 12, a pair of side walls 22 that extend upwardly from the bottom wall 20 for resting on the counter top 12, and a rear wall 24 that extends upwardly from the bottom wall 20, from one side wall 22 to the other side wall 22, for resting on the counter top 12.

The bottom wall 20 comprises a plurality of slats 26 that extend transversely and horizontally, are disposed parallel to each other, are coplanar with each other for supporting the drain board 14 on a depending incline towards the sink 16, and are spaced-apart from each other for providing drainage for leaks from the drain board 14.

Each slat 26 is thin, flat, rectangular-parallelepiped-shaped, land has a pair of terminal ends 28.

Each terminal end 28 of each slot 26 is formed into a tenon 30.

The pair of side walls 22 extend vertically, are disposed parallel to each other, and are spaced-apart from each other for cradling the drain board 14 therebetween.

Each side wall 22 is thin, flat, generally right-triangular-shaped, and as a result thereof, has a leg 32 for resting horizontally on the counter top 12, wherein the leg 32 terminates in a vertex 33, a base 34 that extends vertically upwardly from the leg 32, a hypothenuse 36 that depends inclined from the base 34 forwardly to the vertex 33, an interior surface 38 that faces the other side wall 22, and an exterior surface 40 for facing the ambient.

The interior surface 38 of each side wall 22 has a plurality of blind mortises 42 that extend from just behind the vertex 33 to just before the base 34, are disposed in line with each other, below, and parallel to, the hypotenuse, and are spaced-apart from each other.

The vertex 33 of each side wall 22 is rounded and depends into a recess 44 in the leg 32 for engaging the rim 18 of the sink 16 so as to provide a stop for preventing the kitchen device 10 from sliding into the sink 16.

The tenon 30 on one terminal end 28 of each slot 26 is received in an associated blind mortise 42 in the interior surface 38 of one side wall 22, while the tenon 30 on the other terminal end 28 of each slot 26 is received in an associated blind mortise 42 in the interior surface 38 of the other side wall 22.

The exterior surface 40 of each side wall 22 has a plurality of countersunk bores 46. Each countersunk bore 46 communicates with an associated blind mortise 42.

Each side wall 22 further has a plurality of wood screws 48. Each wood screw 48 of each side wall 22 extends in an associated countersunk bore 46 and threadably into an associated tenon 30 so as to hold the plurality of slats 26 between the pair of side walls 22.

Each side wall 22 further has a plurality of wood plugs 50. Each wood plug 50 of each side wall 22 fills an associated countersunk bore 46 flush so as to prevent an associated wood screw 48 from working loose.

The rear wall 24 is thin, flat, rectangular-parallelepiped-shaped, and has a;lowermost edge 52 for resting on the counter top 12, and a pair of ends 54.

One end 54 of the rear wall 24 abuts against the interior surface 38 of one side wall 22, at the base 34 thereof, while the other end 54 of the rear wall 24 abuts against the interior surface 38 of the other side wall 22, at the base 34 thereof.

The exterior surface 40 of each side wall 22 has a pair of countersunk bores: 56 that are vertically aligned, and are disposed parallel to, and just before, the base 34.

Each side wall 22 further has a pair of wood screws 58. Each wood screw 58 of each side wall 22 extends in an associated countersunk bore 56 and threadably into an associated end 54 of the wall 24 so as to hold the rear wall 24 between the pair of side walls 22.

Each side wall 22 further has a pair of wood plugs 60. Each wood plug 60 of each side wall 22 fills an associated countersunk bore 56 flush so as to prevent an associated wood screw 58 from working loose.

It will be understood that each of the elements described above, or two or more together, may also find a useful application in other types of constructions differing from the types described above.

While the invention has been illustrated and described as embodied in a kitchen device for resting on a counter top and pitching a drain board supported thereon into a sink in the counter top, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A kitchen device for resting on a counter top and pitching a drain board supported thereon into a sink in the counter top, wherein the sink has a rim therearound that rests on the counter top, said device comprising:

a) a bottom wall for facing the counter top;

b) a pair of side walls extending upwardly from said bottom wall for resting on the counter top; and c) a rear wall extending upwardly from said bottom wall, from one side wall to the other side wall, for resting on the counter top;

wherein each side wall is thin, flat, generally right-triangular-shaped, and as a result thereof, has:

i) a leg for resting horizontally on the counter top, wherein said leg terminates in a vertex;

ii) a base that extends vertically upwardly from said leg;

iii) a hypothenuse that depends inclined from said base forwardly to said vertex;

iv) an interior surface that faces the other side wall; and v) an exterior surface for facing the ambient; and wherein said vertex of each side wall is rounded and depends into a recess in said leg for engaging the rim of the sink so as to provide a stop for preventing said kitchen device from sliding into the sink.

2. The device as defined in claim 1, wherein said bottom wall comprises a plurality of slats that extend transversely and horizontally, are disposed parallel to each other, are coplanar with each other for supporting the drain board on a depending incline towards the sink, and are spaced-apart from each other for providing drainage for leaks from the drain board.

3. The device as defined in claim 2, wherein each slat is thin, flat, rectangular-parallelepiped-shaped, and has a pair of terminal ends.

4. The device as defined in claim 3, wherein each terminal end of each slot is formed into a tenon.

5. The device as defined in claim 1, wherein said pair of side walls extend vertically, are disposed parallel to each other, and are spaced-apart from each other for cradling the drain board therebetween.

6. The device as defined in claim 1, wherein said interior surface of each side wall has a plurality of blind mortises that extend from Just behind said vertex to Just before said base, are disposed in line with each other, below, and parallel to, said hypotenuse, and are spaced-apart from each other.

7. The device as defined in claim 6, wherein said tenon on one terminal end of each slot is received in an associated blind mortise in said interior surface of one side wall, while said tenon on the other terminal end of each slot is received in an associated blind mortise in said interior surface of the other side wall.

8. The device as defined in claim 6, wherein said exterior surface of each side wall has a plurality of countersunk bores.

9. The device as defined in claim 8, wherein each countersunk bore communicates with an associated blind mortise.

10. The device as defined in claim 8, wherein each side wall further has a plurality of wood screws.

11. The device as defined in claim 10, wherein each wood screw of each side wall extends in an associated countersunk bore and threadably into an associated tenon so as to hold said plurality of slats between said pair of side walls.

12. The device as defined in claim 10, wherein each side wall further has a plurality of wood plugs.

13. The device as defined in claim 12, wherein each wood plug of each side wall fills an associated countersunk bore flush so as to prevent an associated wood screw from working loose.

14. The device as defined in claim 6, wherein said rear wall is thin, flat, rectangular-parallelepiped-shaped, and has:

a) a lowermost edge for resting on the counter top; and b) a pair of ends.

15. The device s defined in claim 14, wherein one end of said rear wall abuts against said interior surface of one side wall, at said base thereof, while the other end of said rear wall abuts against said interior surface of the other side wall, at said base thereof.

16. The device as defined in claim 14, wherein said exterior surface of each side wall has a pair of countersunk bores that are vertically aligned, and are disposed parallel to, and just before, said base.

17. The device as defined in claim 16, wherein each side wall further has a pair of wood screws.

18. The device as defined in claim 17, wherein each wood screw of each side wall extends in an associated countersunk bore and threadably into an associated end of said rear wall so as to hold said rear wall between said pair of side walls.

19. The device as defined in claim 17, wherein each side wall further has a pair of wood plugs.

20. The device as defined in claim 19, each wood plug of each side wall fills an associated countersunk bore flush so as to prevent an associated wood screw from working loose.

* * * * *